US005341127A

United States Patent [19]

Smith

[11] Patent Number: 5,341,127

[45] Date of Patent: Aug. 23, 1994

[54] SELF-CONTAINED BED WETTING ALARM

[76] Inventor: Robert J. Smith, 1285 N. Cedarbrook Rd., Boulder, Colo. 80304

[21] Appl. No.: 163,605

[22] Filed: Dec. 6, 1993

Related U.S. Application Data

[63] Continuation of Ser. No. 856,398, Mar. 23, 1992, abandoned.

[51] Int. Cl.[5] ..... G08B 21/00

[52] U.S. Cl. ..... 340/604; 340/573; 340/407.1; 128/886; 604/361

[58] Field of Search ..... 340/603, 604, 605, 573, 340/407, 620, 825.46, 407.1; 128/885, 886, DIG. 25; 604/361

[56] References Cited

U.S. PATENT DOCUMENTS 4,106,001 8/1978 Mahoney ..... 340/604
4,731,603 3/1988 McRae et al. ..... 340/407
4,794,392 12/1988 Selinko ..... 340/407 X
4,796,014 1/1989 Chia ..... 340/604 X
4,800,370 1/1989 Vetechik ..... 128/886 X
4,977,906 12/1990 Di Scipio ..... 340/604 X

*Primary Examiner*—Jeffery A. Hofsass
*Attorney, Agent, or Firm*—Homer L. Knearl

[57] ABSTRACT

A compact self-contained bedwetting alarm uses intermittent vibration to awaken the user. Sensors on the surface of the alarm enclosure sense the presence of urine and activate a low frequency vibration. The vibration is turned on and off by a timer so that the user is not lulled to sleep by the vibration. The alarm may be worn in close proximity to the source of urine. There are no external wires to entangle, and the position of the alarm close to the source of urine reminds the user to control the emission of urine when the alarm is on.

8 Claims, 1 Drawing Sheet

SELF-CONTAINED BED WETTING ALARM

This case is a continuation of Ser. No. 07/856,398 filed Mar. 23, 1992, now abandoned.

FIELD OF THE INVENTION

This invention relates to a self-contained bedwetting alarm.

BACKGROUND

A number of bed wetting alarms exist in the prior art. They typically sense the presence of urine by its electrical conductivity, creating an electrical signal which is then used to set off an alarm. The alarm, typically a buzzer or other audible alarm, must wake the user as quickly as possible after urine has been detected in order to minimize the necessary user response, and to facilitate the user's, learning to avoid bedwetting.

The problem is that audible alarms must be remote from the sensor because their sound is muffled by passage through bedding, clothing etc. This requires that the alarm be connected to the sensor by wires or in some cases radio signals. In order that the alarm wake the user quickly, it often remoted to a bedside nightstand or in some cases to a shoulder-top location. But the variability in the user's sleeping position makes precise control of the decibel level at the user's ear impossible. Thus very loud alarms must be used, especially for deep sleepers, to compensate for unpredictable muffing of the sound of the alarm. While the extent to which a pillow or other article can muffle such alarms is in practice too great to overcome, the very attempt to do so results in a potential for hearing loss when said muffling does not take place. And in general, the ability of even an earpiercing alarm to wake a deep sleeper is often inadequate.

In any case, the awkwardness and risk of entanglement inherent in use of wires around a sleeping child makes the use of such alarms much less attractive.

SUMMARY OF THE INVENTION

1. It is an objective of the invention to provide a completely selfcontained bedwetting alarm which is unobtrusive and is not cumbersome to use.

2. It is an objective of the invention to alert the user at the earliest possible moment so as to simplify the corrective actions required, and to facilitate the user's learning to avoid bedwetting.

3. It is an objective of the invention to be able to alert only the user, so embarassment can be avoided in the presence of others.

4. It is an objective of the invention to be inherently safe to the user, avoiding risk of both entanglement in wires, and impairment of hearing.

These objectives are realized by including a wetness sensor along with detection circuitry and a low frequency mechanical vibration device in a compact enclosure which fits comfortably in or near the undergarments of the user. These vibrations, which may be induced by use of an unbalanced motor or solenoid or any similar electromechanical device, propagate easily through any dense media such as clothing, bedding, or human tissue to waken the user. The total volume of the assembly can be on the order of 4 cubic inches.

The advantages of this invention are that it avoids risk of entanglement and/or hearing impairment, and is easy to use. Further, it wakes only the user, not others who may be present. Also, the integral moisture sensors' small surface area permits early detection of urine. Thus, it simplifies the necessary user response while it facilitates the user's learning process. Other objects, advantages and features of the invention will be understood by those of ordinary skill in the art after referring to the complete written description of the preferred embodiments in conjunction with the following drawings.

DESCRIPTION OF THE PREFERRED EMBODIMENT

Figure 1:
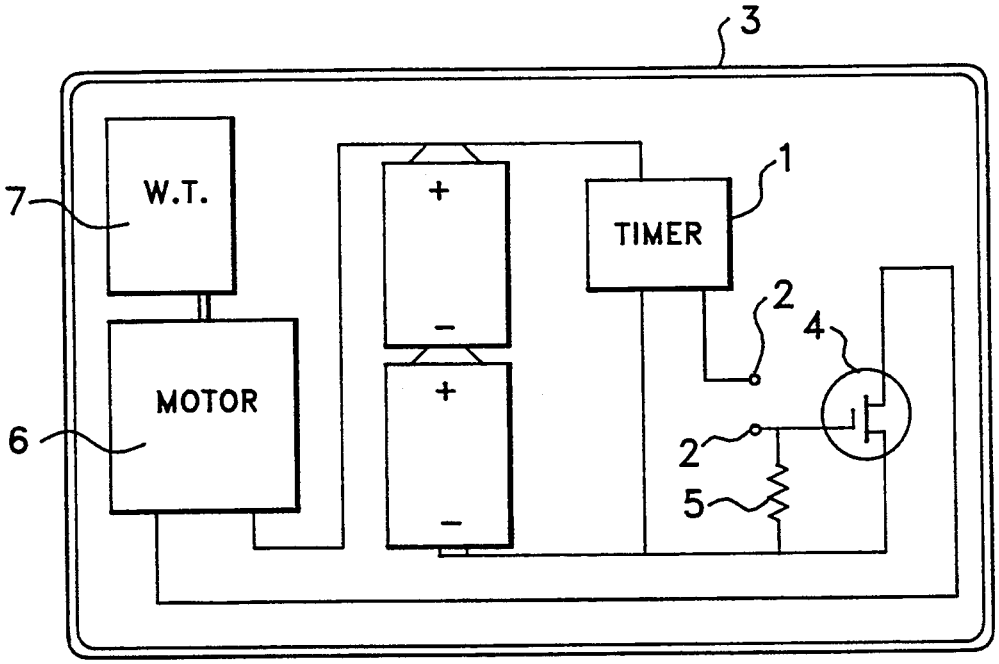
FIG. 1 is a schematic view of the invention.

As shown in FIG. 1, the preferred embodiment includes a timer circuit 1 whose output voltage, which may be as low as 2 volts, is periodically made available at one of two sensor terminals 2. These terminals extend through the enclosure wall 3 to permit contact with the user's undergarment. The second terminal is connected to the gate of a field effect transistor 4 and to a resistor 5 whose other end is grounded along with the source of the field effect transistor (FET). The resistor serves to keep the gate shorted to ground until urine bridges the sensors. Then the periodic clock output voltage raises the gate-to-source voltage in proportion to the sensors' wetness. This renders the FET conductive between its drain and source and so permits a periodic flow of current through the motor 6. Thus the motor cycles on and off at the timer rate, typically about 20 cycles per minute.

Attached to the motor shaft is an unbalanced weight 7. When the motor runs, the weight causes the entire assembly to vibrate vigorously; the vibration is at the lower extreme of the audio spectrum, about 30 cycles per second, so the small size of the vibrating assembly prevents sound propagation through the air. But the vibration is easily detected by the user, even though asleep, because it propagates efficiently throughout the user's body and mattress.

Figure 2:
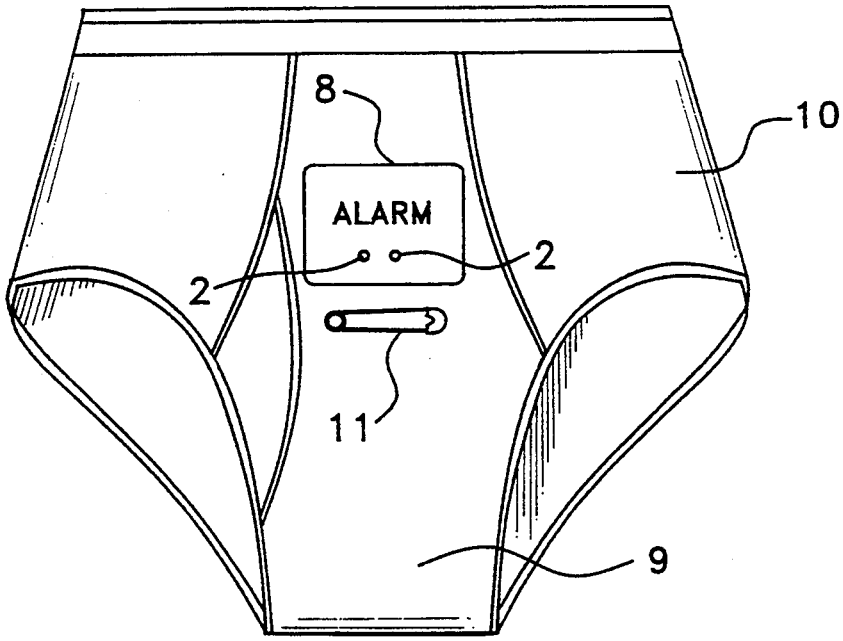
FIG. 2 shows the enclosure in which the invention is housed and a preferred location of the invention with respect to the user's undergarment.

While various means could be used to hold the invention in place, FIG. 2 shows a particularly simple and effective approach. The invention 8 is inserted between the double layers of cloth 9 at the front of ordinary, boys' underwear 10. The sensors 2 are thus in secure contact with the fabric and a single safety pin 11 can be used to ensure that the assembly stays put.

What is claimed is:

1. A nocturnal bedwetting alarm for alerting a sleeping user to a presence of urine by discontinuous mechanical vibrations, said alarm comprises:

an enclosure for housing the entire alarm, said enclosure has a sensing surface;

at least two sensor terminals on said sensing surface of said enclosure for sensing the presence of urine;

an electromechanical device for inducing mechanical vibrations in said enclosure;

switching means responsive to said terminals sensing the presence of urine for applying voltage to said electromechanical device so that said device induces vibrations in said enclosure; and a timer circuit electrically connected between said switching means and said electromechanical device to alternately open and close the circuit's electrical connection between said switching means and said electromechanical device so as to produce discontinuities in vibrations in said enclosure and thereby awaken the user.

2. The alarm of claim 1 wherein said electromechanical device induces mechanical vibrations at the lower extreme of the audio spectrum and said timer circuit alternately opens and closes the electrical connection in tens of cycles per minute.

3. Alarm apparatus for discontinuously vibrating a sleeping user upon detecting a presence of urine in close proximity to the source of urine, said apparatus is compact, self-contained and comprises:

an enclosure means for enclosing the entire alarm apparatus, said enclosure means has a surface positioned in close proximity to the source of urine;

means for vibrating said enclosure means;

means proximate to said surface of said enclosure means for sensing the presence of urine;

switching means responsive to said sensing means for switching on said vibrating means; and cycling means responsive to said switching means for cycling said vibrating mean on and off to produce discontinuous vibration of said enclosure means whereby the discontinuous vibration of said enclosure means in close proximity to the source of urine awakens the user and alerts the user to stop urination.

4. The apparatus of claim 3 wherein said vibrating means vibrates said enclosure means at a frequency in the lower extreme of the audio spectrum.

5. The alarm apparatus of claim 4 wherein said cycling means cycles said vibrating means on and off in tens of cycles per minute.

6. The alarm apparatus of claim 4 wherein said cycling means cycles said vibrating means on and off about 20 cycles per minute.

7. The alarm apparatus of claim 3 wherein said vibrating means vibrates said enclosure means at substantially 30 cycles per second.

8. The alarm apparatus of claim 7 wherein said cycling means cycles said vibrating means on and off at substantially 20 cycles per minute.

* * * * *